US010217409B2

(12) United States Patent
Hu et al.

(10) Patent No.: US 10,217,409 B2
(45) Date of Patent: Feb. 26, 2019

(54) PIXEL CIRCUIT AND DRIVING METHOD THEREFOR, AND ORGANIC LIGHT-EMITTING DISPLAY

(71) Applicants: KUNSHAN NEW FLAT PANEL DISPLAY TECHNOLOGY CENTER CO., LTD., KunShan, Jiangsu (CN); KUNSHAN GO-VISIONOX OPTO-ELECTRONICS CO., LTD., KunShan (CN)

(72) Inventors: Siming Hu, KunShan (CN); Hui Zhu, KunShan (CN); Nan Yang, KunShan (CN); Tingting Zhang, KunShan (CN); Zhouying Liu, KunShan (CN); Xiuqi Huang, KunShan (CN)

(73) Assignees: KUNSHAN NEW FLAT PANEL DISPLAY TECHNOLOGY CENTER CO., LTD., Jiangsu (CN); KUNSHAN GO-VISIONOX OPTO-ELECTRONICS Co., LTD., Jiangsu (CN)

( * ) Notice: Subject to any disclaimer, the term of this patent is extended or adjusted under 35 U.S.C. 154(b) by 162 days.

(21) Appl. No.: 15/518,141

(22) PCT Filed: Sep. 25, 2015

(86) PCT No.: PCT/CN2015/090664

§ 371 (c)(1),
(2) Date: Apr. 10, 2017

(87) PCT Pub. No.: WO2016/058475

PCT Pub. Date: Apr. 21, 2016

(65) Prior Publication Data

US 2017/0294162 A1 Oct. 12, 2017

(30) Foreign Application Priority Data

Oct. 15, 2014 (CN) ..... 2014 1 0545393

(51) Int. Cl.
*G09G 3/3241* (2016.01)
*G09G 3/3233* (2016.01)
*G09G 3/3266* (2016.01)

(52) U.S. Cl.
CPC ..... *G09G 3/3241* (2013.01); *G09G 3/3233* (2013.01); *G09G 3/3266* (2013.01);
(Continued)

(58) Field of Classification Search
CPC ..... G09G 3/30; G09G 3/32; G09G 3/3241; G09G 3/3233; G09G 3/3266;
(Continued)

(56) References Cited

U.S. PATENT DOCUMENTS

2010/0177024 A1* 7/2010 Choi ..... G09G 3/3233 345/76
2011/0157126 A1 6/2011 Chung et al.
(Continued)

FOREIGN PATENT DOCUMENTS

CN 102117598 A 7/2011
CN 102222465 A 10/2011
(Continued)

*Primary Examiner* — Lunyi Lao
*Assistant Examiner* — Johny Lau
(74) *Attorney, Agent, or Firm* — Muncy, Geissler, Olds & Lowe, P.C.

(57) ABSTRACT

A pixel circuit and a method therefor, and an organic light-emitting display. The pixel circuit initializes an anode of an organic light-emitting diode (OLED) by means of a first thin-film transistor, a second thin-film transistor and a seventh thin-film transistor, and initializes a gate and a drain of a sixth thin-film transistor serving as a driving element by means of the first thin-film transistor, a third thin-film transistor and the seventh thin-film transistor so that the service life of the OLED and the service life of the sixth thin-film transistor are prolonged. The current output by the
(Continued)

sixth thin-film transistor serving as a driving element is irrelevant to the threshold voltage of the sixth thin-film transistor and the impedance of the power wiring, and thus uneven brightness caused by deviation of the threshold voltage of the thin-film transistor and different impedances of the power wiring can be avoided. Therefore, for the organic light-emitting display that adopts the pixel circuit and the driving method therefor, the service life is prolonged and the display quality is improved.

19 Claims, 4 Drawing Sheets

(52) U.S. Cl.
CPC ..... *G09G 2300/0819* (2013.01); *G09G 2300/0852* (2013.01); *G09G 2300/0861* (2013.01); *G09G 2310/0202* (2013.01); *G09G 2310/0251* (2013.01); *G09G 2310/0262* (2013.01); *G09G 2320/0223* (2013.01); *G09G 2320/0233* (2013.01); *G09G 2320/043* (2013.01); *G09G 2320/045* (2013.01); *G09G 2330/028* (2013.01)

(58) Field of Classification Search
CPC ... G09G 2300/0852; G09G 2300/0861; G09G 2310/0251; G09G 2310/0262; G09G 2320/0223; G09G 2320/045; G09G 2300/0819; G09G 2310/0202; G09G 2320/043; G09G 2330/028
See application file for complete search history.

(56) References Cited

U.S. PATENT DOCUMENTS

| | | | | |
|---|---|---|---|---|
| 2011/0157216 | A1 | 6/2011 | Yamazaki et al. | |
| 2012/0019501 | A1* | 1/2012 | Choi ..... | G09G 3/3233 345/211 |

FOREIGN PATENT DOCUMENTS

| | | | |
|---|---|---|---|
| CN | 102339586 | A | 2/2012 |
| CN | 103077677 | A | 5/2013 |
| CN | 103578410 | A | 2/2014 |
| CN | 104050917 | A | 9/2014 |
| JP | 2005202070 | A | 7/2005 |
| JP | 201039461 | A | 2/2010 |
| KR | 20100047694 | A | 5/2010 |
| TW | 200603048 | A | 1/2006 |
| TW | 200811782 | A | 3/2008 |
| TW | 201201180 | A | 1/2012 |
| TW | 201211982 | A | 3/2012 |
| TW | 201349610 | A | 12/2013 |
| TW | 201426705 | A | 7/2014 |
| TW | 201430810 | A | 8/2014 |
| TW | 201503086 | A | 1/2015 |
| TW | 201503085 | A | 1/2016 |

* cited by examiner

PIXEL CIRCUIT AND DRIVING METHOD THEREFOR, AND ORGANIC LIGHT-EMITTING DISPLAY

TECHNICAL FIELD

The present invention relates to the field of flat panel display devices and, in particular, to a pixel circuit and a method for driving it, as well as to an organic light-emitting display device.

BACKGROUND

Differing from thin-film-transistor liquid-crystal display (TFT-LCD) devices which rely on backlight systems for light emission, organic light-emitting display devices emit light by themselves and hence provide higher visibility and brightness and can be made thinner. At present, organic light-emitting display devices are praised as the next generation display devices that will replace the TFT-LCD devices.

Reference is now made to FIG. 1 which shows a circuit diagram of a pixel in an organic light-emitting display device of the prior art. As shown in FIG. 1, each pixel in the organic light-emitting display device includes a pixel circuit 10 and an organic light-emitting diode OLED. The pixel circuit 10 is connected to a data line Dm and a scan line Sn so as to control light emission of the organic light-emitting diode OLED. The pixel circuit 10 includes a switch thin-film transistor M1, a drive thin-film transistor M2 and a capacitor Cst. The switch thin-film transistor M1 has a gate connected to a scan line Sn and a source connected to a data line Dm. The drive thin-film transistor M2 has a gate connected to a drain of the switch thin-film transistor M1, a source connected to a first power source ELVDD via a first power wiring (not shown) and a drain connected to an anode of the organic light-emitting diode OLED. A cathode of the organic light-emitting diode OLED is connected to a second power source ELVSS via a second power wiring (not shown). The organic light-emitting diode OLED emits light under the effect of a current provided by the pixel circuit 10. The capacitor Cst is connected between the gate and source of the drive thin-film transistor M2 in order to maintain a digital signal at the gate of the switch thin-film transistor M1 and a threshold voltage of the drive thin-film transistor M2 over a predetermined period of time.

However, during the manufacturing process of the thin-film transistors, variations may occur in their threshold voltages. Such variations in threshold voltages of the thin-film transistor that act as driving elements may lead to the organic light-emitting diode OLED emitting light with different brightness levels in response to the digital signal which is, however, indicative of the same brightness level. This may lead to brightness non-uniformity and hence reduced display quality.

Further, the power wiring connecting the first power source ELVDD and the pixel circuits 10 have certain impedances which lead to voltage drops when currents flow in them and hence uneven positive power source voltages supplied to the pixel circuits 10, thus further reduce brightness uniformity. Another factor that may deteriorate the problem of non-uniform brightness is light-emission efficiency degradation of the organic light-emitting diodes OLED due to their aging over time.

SUMMARY OF THE INVENTION

It is an object of the present invention to provide a pixel circuit and a method for driving it, as well as an organic light-emitting display device, in order to address the problem of non-uniform brightness arising from the use of the conventional organic light-emitting display device.

This object is attained by a pixel circuit according to the present invention, including a first thin-film transistor, a second thin-film transistor, a third thin-film transistor, a fourth thin-film transistor, a fifth thin-film transistor, a sixth thin-film transistor, a seventh thin-film transistor, a capacitor and an organic light-emitting diode, wherein a source of the sixth thin-film transistor is connected to a first power source; a drain of the sixth thin-film transistor is connected to both a drain of the first thin-film transistor and a source of the second thin-film transistor; a drain of the second thin-film transistor is connected to an anode of the organic light-emitting diode; a cathode of the organic light-emitting diode is connected to a second power source; a gate of the sixth thin-film transistor is connected to a source of the third thin-film transistor and a first terminal of the capacitor; a second terminal of the capacitor is connected to both a drain of the fourth thin-film transistor and a source of the fifth thin-film transistor; a source of the fourth thin-film transistor is connected to a data line; a drain of the fifth thin-film transistor, together with a drain of the seventh thin-film transistor, is connected to a reference power source; and a source of the seventh thin-film transistor is connected to both a source of the first thin-film transistor and a drain of the third thin-film transistor.

Optionally, in the pixel circuit, the first power source and the second power source may be configured to provide the organic light-emitting diode with power supply voltages, wherein a reference power source is configured to provide an initialization voltage to the gate and drain of the sixth thin-film transistor and the anode of the organic light-emitting diode.

Optionally, in the pixel circuit, the gates of the second thin-film transistor and the fifth thin-film transistor may be both connected to a first scan line which is configured for control initialization and capacitor stabilization, wherein the gates of the first thin-film transistor, the third thin-film transistor and the fourth thin-film transistor are all connected to a second scan line which is configured to control writing of a data voltage and sample a threshold voltage of the sixth thin-film transistor, and the gate of the seventh thin-film transistor is connected to a third scan line which is configured to control writing of the initialization voltage.

Optionally, in the pixel circuit, a scan period for driving the pixel circuit may include a first phase, a second phase, a third phase and a fourth phase;

wherein an initialization of the gate and drain of the sixth thin-film transistor and the anode of the organic light-emitting diode is started at a beginning of the first phase; the initialization of the anode of the organic light-emitting diode is terminated at an end of the second phase; the initialization of the gate and drain of the sixth thin-film transistor is terminated at an end of the third phase; a threshold voltage of the sixth thin-film transistor is sampled in the third phase; and the sixth thin-film transistor is turned on and provides a current to the organic light-emitting diode in the fourth phase.

Optionally, in the pixel circuit, the current provided by the sixth thin-film transistor to the organic light-emitting diode may be determined by the data voltage provided by the data line and the initialization voltage provided by the reference power source, and be independent of the power supply voltages provided by the first power source and the second power source and the threshold voltage of the sixth thin-film transistor.

Optionally, the pixel circuit may further include a boost capacitor disposed between the second scan line and a connection point among the gate of the sixth thin-film transistor, the source of the third thin-film transistor and a first terminal of the capacitor.

Accordingly, the present invention also provides a method for driving the pixel circuit as defined above, including:

a scan period including a first phase, a second phase, a third phase and a fourth phase, wherein in the first phase, a scan signal provided by the first scan line is maintained at a low level and a scan signal provided by the second scan line and a scan signal provided by the third scan line are both pulled down from a high level to the low level, leading to the first thin-film transistor, the third thin-film transistor, the fourth thin-film transistor and the seventh thin-film transistor being turned on, with the second thin-film transistor and the fifth thin-film transistor being maintained in an on state, the gate and drain of the sixth thin-film transistor and the anode of the organic light-emitting diode being initialized by an initialization voltage provided by the reference power source, and a data voltage provided by the data line being written, via the fourth thin-film transistor, to a connection point among the drain of the fourth thin-film transistor, the source of the fifth thin-film transistor and the second terminal of the capacitor;

in the second phase, the scan signal provided by the first scan line jumps from the low level to the high level and the scan signals provided by the second scan line and the third scan line are maintained at the low level, leading to the second thin-film transistor and the fifth thin-film transistor being turned off and the initialization of the anode of the organic light-emitting diode being terminated;

in the third phase, the scan signal provided by the first scan line is maintained at the high level, the scan signal provided by the second scan line is maintained at the low level and the scan signal provided by the third scan line jumps from the low level to the high level, leading to the seventh thin-film transistor being turned off, the second thin-film transistor being kept off, the initialization of the gate and drain of the sixth thin-film transistor being terminated, and the threshold voltage of the sixth thin-film transistor being sampled;

in the fourth phase, the scan signals provided by the first scan line and the third scan line are maintained at the high level and the scan signal provided by the second scan line jumps from the low level to the high level, leading to the first thin-film transistor, the third thin-film transistor and the fourth thin-film transistor being turned off, writing of the data voltage being terminated, and the sampling of the threshold voltage of the sixth thin-film transistor being completed, and following the completion of the sampling, the scan signal provided by the first scan line drops from the high level to the low level, leading to the second thin-film transistor and the fifth thin-film transistor being turned on, and the sixth thin-film transistor outputting a current via the second thin-film transistor, which drives the organic light-emitting diode to emit light.

Optionally, in the method, when the seventh thin-film transistor and the third thin-film transistor are simultaneously turned on, the gate of the sixth thin-film transistor may be initialized by the reference power source;

when the first thin-film transistor and the seventh thin-film transistor are simultaneously turned on, the drain of the sixth thin-film transistor is initialized by the reference power source;

when the first thin-film transistor, the second thin-film transistor and the seventh thin-film transistor are simultaneously turned on, the anode of the organic light-emitting diode is initialized by the reference power source.

Optionally, in the method, in response to the scan signal provided by the second scan line, a boost capacitor raises a voltage at a connection point between the gate of the sixth thin-film transistor and the source of the third thin-film transistor as well as a first terminal of the capacitor in the fourth phase, such that a gate voltage of the sixth thin-film transistor is increased.

Accordingly, the present invention also provides an organic light-emitting display device, including the pixel circuit as described above.

In the pixel circuit and the method for driving it, as well as the organic light-emitting display device, according to the present invention, through anode initialization of the organic light-emitting diode via the first thin-film transistor, the second thin-film transistor and the seventh thin-film transistor, as well as gate and drain initialization of the sixth thin-film transistor that serves as a driving element via the first thin-film transistor, the third thin-film transistor and the seventh thin-film transistor, therefore, aging of the organic light-emitting diode and the sixth thin-film transistor can be slowed, and their service lives can be extended. In addition, because the current output by the sixth thin-film transistor that serves as the driving element is independent of its threshold voltage and impedances of power wiring, brightness non-uniformity caused by variations in thin-film transistor threshold voltages and power wiring impedances can be avoided. Therefore, the organic light-emitting display device using the pixel circuit, as well as the method for driving it can result in not only service life extension but also an improvement in display quality.

DETAILED DESCRIPTION

Pixel circuits and driving methods thereof, as well as organic light-emitting display devices, according to the present invention, will be described below with reference to specific embodiments and the accompanying drawings. The advantages and feature of the invention will become more apparent from the following description and the appended claims. It is noted that the drawings are presented in a very simplified form not precisely drawn to scale with the only purpose of facilitating the description of the embodiments of the invention.

Embodiment 1

Figure 1:
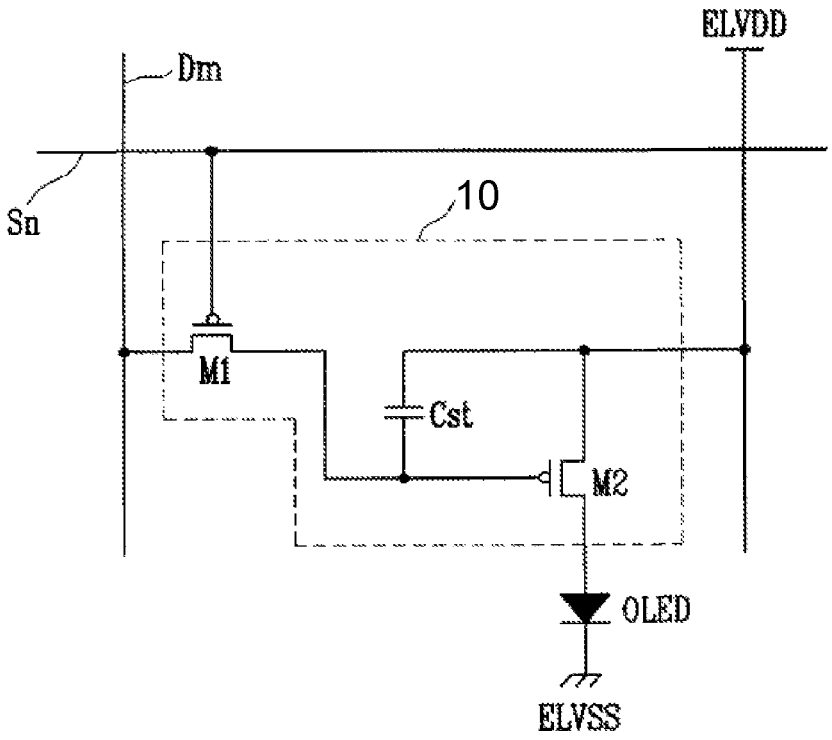
FIG. 1 shows a circuit diagram of a pixel in an organic light-emitting display device of the prior art.
Figure 2:
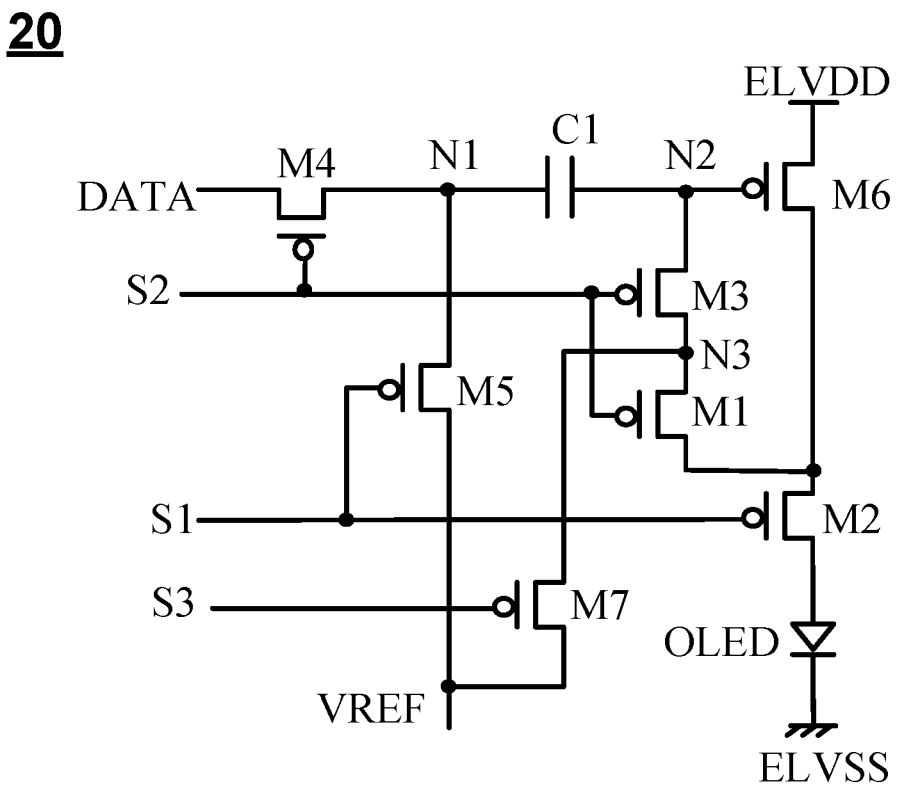
FIG. 2 is a diagram of a pixel circuit in accordance with a first embodiment of the present invention.

Reference is now made to FIG. 2, which is a schematic illustration of a pixel circuit in accordance with a first embodiment of the present invention. As shown in FIG. 2, the pixel circuit 20 comprises a first thin-film transistor M1, a second thin-film transistor M2, a third thin-film transistor M3, a fourth thin-film transistor M4, a fifth thin-film transistor M5, a sixth thin-film transistor M6, a seventh thin-film transistor M7, a capacitor C1 and an organic light-emitting diode OLED. The source of the sixth thin-film transistor M6 is connected to a first power source ELVDD, and the drain of the sixth thin-film transistor M6 is connected to both the drain of the first thin-film transistor M1 and the source of the second thin-film transistor M2. The drain of the second thin-film transistor M2 is connected to an anode of the organic light-emitting diode OLED, and a cathode of the organic light-emitting diode OLED is connected to a second power source ELVSS. The gate of the sixth thin-film transistor M6 is connected to the source of the third thin-film transistor M3 and a first terminal of the capacitor C1. A second terminal of the capacitor C1 is connected to both the drain of the fourth thin-film transistor M4 and the source of the fifth thin-film transistor M5. The source of the fourth thin-film transistor M4 is connected to a data line DATA, and the drain of the fifth thin-film transistor M5, together with the drain of the seventh thin-film transistor M7, is connected to a reference power source VREF. The source of the seventh thin-film transistor M7 is connected to both the source of the first thin-film transistor M1 and the drain of the third thin-film transistor M3.

Specifically, the pixel circuit 20 is supplied with the first power source ELVDD, the second power source ELVSS and the reference power source VREF externally (e.g., from a power supply unit) via power wiring (not shown). The first power source ELVDD and the second power source ELVSS are provided to drive the organic light-emitting diode OLED, i.e., providing the organic light-emitting diode OLED with power supply voltages, and the reference power source VREF is configured to provide an initialization voltage Vref. In general, the first power supply voltage VDD provided by the first power source ELVDD has a high level, and the second power supply voltage VSS provided by the second power source ELVSS has a low level. The initialization voltage Vref provided by the reference power source VREF is a direct current (DC) voltage having a constant value that is generally negative or close to 0 V.

As shown in FIG. 2, the source of the sixth thin-film transistor M6 is connected to the first power source ELVDD, and the drain of the sixth thin-film transistor M6 is connected to the anode of the organic light-emitting diode OLED via the second thin-film transistor M2. The cathode of the organic light-emitting diode OLED is connected to the second power source ELVSS. The sixth thin-film transistor M6 acts as a drive transistor to provide the organic light-emitting diode OLED with a current, and the organic light-emitting diode OLED emits light in response to this current.

With continued reference to FIG. 2, the drain of the fifth thin-film transistor M5 and the drain of the seventh thin-film transistor M7 are both connected to the reference power source VREF. The source of the fifth thin-film transistor M5 is connected to a first node N1, and the gate of the fifth thin-film transistor M5 is connected to a first scan line S1, so that the fifth thin-film transistor M5 can respond to a scan signal provided by the first scan line S1 to provide the initialization voltage Vref from the reference power source VREF to the first node N1. The source of the seventh thin-film transistor M7 is connected to a third node N3 and the gate of the seventh thin-film transistor M7 is connected to a third scan line S3, so that the seventh thin-film transistor M7 can respond to a scan signal provided by the third scan line S3 to provide the initialization voltage Vref from the reference power source VREF to the third node N3. The source of the third thin-film transistor M3 is connected to a second node N2 and the gate of the third thin-film transistor M3 is connected to a second scan line S2, so that the third thin-film transistor M3 can respond to a scan signal provided by the second scan line S2 to provide a voltage at the third node N3 to the second node N2. The gate of the first thin-film transistor M1 is connected to the second scan line S2 and the gate of the second thin-film transistor M2 is connected to the first scan line S1, so that the first thin-film transistor M1 and the second thin-film transistor M2 can respond to the scan signals provided by the second scan line S2 and the first scan line S1, respectively, to provide the voltage at the third node N3 to the anode of the organic light-emitting diode OLED.

As shown in FIG. 2, when the fifth thin-film transistor M5 is turned on, the initialization voltage Vref provided by the reference power source VREF is applied to the first node N1. When the seventh thin-film transistor M7 is turned on, the initialization voltage Vref provided by the reference power source VREF is applied to the third node N3. When the seventh thin-film transistor M7, the third thin-film transistor M3 and the first thin-film transistor M1 are simultaneously turned on, the initialization voltage Vref provided by the reference power source VREF to the third node N3 is applied to the second node N2 and the drain of the sixth thin-film transistor M6, thereby initializing the gate and drain of the drive transistor M6. When the seventh thin-film transistor M7, the first thin-film transistor M1 and the second thin-film transistor M2 are simultaneously turned on, the initialization voltage Vref provided by the reference power source VREF is applied to the anode of the organic light-emitting diode OLED, thereby initializing the anode of the organic light-emitting diode OLED.

With continued reference to FIG. 2, the source of the fourth thin-film transistor M4 is connected to the data line DATA on which a data voltage Vdata output by a drive chip (not shown) is transmitted. The drain of the fourth thin-film transistor M4 is connected to both the second terminal of the capacitor C1 and the source of the fifth thin-film transistor M5, and the gate of the fourth thin-film transistor M4 is connected to the second scan line S2, so that the fourth thin-film transistor M4 can respond to the scan signal provided by the second scan line S2 to provide the data voltage Vdata transmitted on the data line DATA to the first node N1.

The fourth thin-film transistor M4 is turned on or off under the effect of the scan signal provided by the second scan line S2, and when the fourth thin-film transistor M4 is turned on, the data line DATA and the first node N1 are electrically connected to each other, thereby providing the data voltage Vdata from the data line DATA to the first node N1.

The capacitor C1 is connected between the first node N1 and the second node N2, in order to control the voltage at the first node N1 such that it corresponds to an amount of voltage change at the second node N2. That is, the difference between the voltages at the second node N2 and the first node N1 will be charged to the capacitor C1. With the charging being completed, the capacitor C1 maintains this voltage difference.

In this embodiment, the pixel circuit 20 is a 7T1C circuit including the seven thin-film transistors and the capacitor. The pixel circuit 20 is connected to the three scan lines. In this embodiment, the gates of the second thin-film transistor M2 and the fifth thin-film transistor M5 are both connected to the first scan line S1 which is configured for initialization control and capacitor stabilization. The gates of the first thin-film transistor M1, the third thin-film transistor M3 and the fourth thin-film transistor M4 are all connected to the second scan line S2 which is configured to control writing of the data voltage Vdata and sample the threshold voltage of the drive transistor. The gate of the seventh thin-film transistor M7 is connected to the third scan line S3 which is configured to control writing of the initialization voltage Vref.

The gate of the sixth thin-film transistor M6 can be initialized when the initialization voltage Vref provided by the reference power source VREF is applied to the gate of the sixth thin-film transistor M6 via the seventh thin-film transistor M7 and the third thin-film transistor M3. The drain of the sixth thin-film transistor M6 can be initialized when the initialization voltage Vref provided by the reference power source VREF is applied to the drain of the sixth thin-film transistor M6 via the seventh thin-film transistor M7 and the first thin-film transistor M1. The anode of the organic light-emitting diode OLED can be initialized when the initialization voltage Vref provided by the reference power source VREF is applied to the anode of the organic light-emitting diode OLED via the seventh thin-film transistor M7, the first thin-film transistor M1 and the second thin-film transistor M2. In this way, the service lives of the organic light-emitting diode OLED and the drive thin-film transistor M6 can be extended.

In addition, the current provided by the sixth thin-film transistor M6 to the organic light-emitting diode OLED is determined by the data voltage Vdata provided by the data line DATA and the initialization voltage Vref provided by the reference power source VERF and is independent of the power supply voltages provided by the first power source ELVDD and the second power source ELVSS and of the threshold voltage of the sixth thin-film transistor M6. Therefore, use of the pixel circuit 20 can avoid non-uniform brightness caused by variations in thin-film transistor threshold voltages and differences in power wiring impedances and hence increase display quality.

Accordingly, the present invention also provides a method for driving the pixel circuit. With combined reference to FIGS. 2 and 3, the method includes:

a scan period including a first phase T1, a second phase T2, a third phase T3 and a fourth phase T4, wherein in the first phase T1, the scan signal provided by the first scan line S1 is maintained at the low level and the scan signals provided by the second scan line S2 and the third scan line S3 are both pulled down from the high level to the low level, leading to the first thin-film transistor M1, the third thin-film transistor M3, the fourth thin-film transistor M4 and the seventh thin-film transistor M7 being turned on, the second thin-film transistor M2 and the fifth thin-film transistor M5 being kept on, the gate and drain of the sixth thin-film transistor M6 and the anode of the organic light-emitting diode OLED being initialized by the initialization voltage Vref provided by the reference power source VREF, and the data voltage Vdata provided by the data line DATA being written, via the fourth thin-film transistor M4, to the connection point N1 between the drain of the fourth thin-film transistor M4 and the source of the fifth thin-film transistor M5 as well as the second terminal of the capacitor C1;

in the second phase T2, the scan signal provided by the first scan line S1 jumps from the low level to the high level and the scan signals provided by the second scan line S2 and the third scan line S3 are maintained at the low level, leading to the second thin-film transistor M2 and the fifth thin-film transistor M5 being turned off and the initialization of the anode of the organic light-emitting diode OLED being terminated;

in the third phase T3, the scan signal provided by the first scan line S1 is maintained at the high level, the scan signal provided by the second scan line S2 is maintained at the low level and the scan signal provided by the third scan line S3 jumps from the low level to the high level, leading to the seventh thin-film transistor M7 being turned off, the second thin-film transistor M2 and the fifth thin-film transistor M5 being kept off, the initialization of the gate and drain of the sixth thin-film transistor M6 being terminated, and the threshold voltage of the sixth thin-film transistor M6 being sampled;

in the fourth phase T4, the scan signals provided by the first scan line S1 and the third scan line S3 are maintained at the high level and the scan signal provided by the second scan line S2 jumps from the low level to the high level, leading to the first thin-film transistor M1, the third thin-film transistor M3 and the fourth thin-film transistor M4 being turned off, writing of the data voltage Vdata being terminated, and the sampling of the threshold voltage of the sixth thin-film transistor M6 being completed; and following the completion of the sampling, the scan signal provided by the first scan line S1 drops from the high level to the low level, leading to the second thin-film transistor M2 and the fifth thin-film transistor M5 being turned on, and the sixth thin-film transistor M6 outputting a current via the second thin-film transistor M2, which drives the organic light-emitting diode OLED to emit light.

In particular, in the first phase T1, following the scan signals provided by the second scan line S2 and the third scan line S3 dropping from the high level to the low level, the first thin-film transistor M1, third thin-film transistor M3, fourth thin-film transistor M4 and seventh thin-film transistor M7 are turned on from cut off mode. Additionally, as the scan signal provided by the first scan line S1 is maintained at the low level, the second thin-film transistor M2 and the fifth thin-film transistor M5 are kept on. As a result, the initialization voltage Vref provided by the reference power source VREF is supplied, via the fifth thin-film transistor M5, to the connection point (first node N1) between the drain of the fourth thin-film transistor M4 and the source of the fifth thin-film transistor M5 as well as the other terminal of the capacitor C1.

At the same time, the initialization voltage Vref provided by the reference power source VREF is supplied to each of: the connection point (third node N3) between the source of the first thin-film transistor M1 and the drain of the third thin-film transistor M3 via the seventh thin-film transistor M7; the gate of the sixth thin-film transistor M6 via the third thin-film transistor M3, thereby initializing the gate of the sixth thin-film transistor M6; the drain of the sixth thin-film transistor M6 via the first thin-film transistor M1, thereby initializing the drain of the sixth thin-film transistor M6; and the anode of the organic light-emitting diode OLED via the first thin-film transistor M1 and the second thin-film transistor M2, thereby initializing the anode of the organic lighting emitting diode OLED. In this way, the aging of the organic light-emitting diode OLED and the drive thin-film transistor M6 is slowed, and their service lives are extended.

In this process, since the fourth thin-film transistor M4 is on, the data voltage Vdata provided by the data line DATA is written to the first node N1 via the fourth thin-film transistor M4. As can be known from the above description, a summed voltage of the data voltage Vdata and the initialization voltage Vref, i.e., Vdata+Vref, is supplied to the first node N1.

In the second phase T2, following the scan signal provided by the first scan line S1 jumping from the low level to the high level, the second thin-film transistor M2 and fifth thin-film transistor M5 are turned off, making the reference power source VREF unable to provide the initialization voltage Vref to the anode of the organic light-emitting diode OLED via the second thin-film transistor M2. The initialization of the anode of the organic light-emitting diode OLED is therefore terminated.

In this process, the initialization of the first node N1 by the reference power source VREF is stopped. Meanwhile, as the fourth thin-film transistor M4 is turned on, only the data voltage Vdata is provided to the first node N1 via the data line DATA.

In the third phase T3, following the scan signal provided by the third scan line S3 jumping from the low level to the high level, the seventh thin-film transistor M7 is turned off and therefore stops providing the initialization voltage Vref provided by the reference power source VREF to the third node N3 between the source of the first thin-film transistor M1 and the drain of the third thin-film transistor M3. This makes the reference power source VREF unable to provide the initialization voltage Vref to the gate and drain of the sixth thin-film transistor M6 via the first thin-film transistor M1, the third thin-film transistor M3 and the seventh thin-film transistor M7. The initialization of the gate and drain of the sixth thin-film transistor M6 is therefore stopped. Meanwhile, as the scan signal provided by the second scan line S2 is maintained at the low level, the first power supply voltage VDD is transmitted from the first power source ELVDD to the source of the sixth thin-film transistor M6, and enables sampling of the threshold voltage of the sixth thin-film transistor M6 and charging of the capacitor C1 until the voltage at the second node N2, i.e., the gate voltage of the sixth thin-film transistor M6, reaches VDD−Vth, where Vth is an absolute value of the threshold voltage of the sixth thin-film transistor M6.

In this process, as the second thin-film transistor M2 is off, the electrical connection between the sixth thin-film transistor M6 serving as a drive transistor and the organic light-emitting diode OLED is blocked, and the organic light-emitting diode OLED hence does not emit light.

In the fourth phase T4, following the scan signal provided by the second scan line S2 jumping from the low level to the high level, the first thin-film transistor M1, the third thin-film transistor M3 and the fourth thin-film transistor M4 are turned off, leading to the writing of the data voltage Vdata and the charging of the capacitor C1 being stopped. As a result, the sampling of the threshold voltage of the sixth thin-film transistor M6 is completed.

In this process, since the fourth thin-film transistor M4 is turned off, writing of the data voltage Vdata provided by the data line DATA to the first node N1 is stopped, and the voltage at the first node N1 is therefore equal to the data voltage Vdata.

Subsequently, the data voltage Vdata provided by the data line DATA drops from the high level to the low level, the drive chip outputs digital signals for the next row of pixels. Meanwhile, as the scan signal provided by the first scan line S1 also drops from the high level to the low level, the second thin-film transistor M2 and the fifth thin-film transistor M5 are turned on, leading to the initialization voltage Vref provided by the reference power source VREF being supplied to the first node N1 via the fifth thin-film transistor M5 and the sixth thin-film transistor M6 being turned on and outputting a current via the second thin-film transistor M2. As the voltage of the capacitor C1 does not change abruptly, the voltage at the second node N2 (i.e., the gate voltage Vg6 of the sixth thin-film transistor M6) varies with the voltage at the first node N1.

As described above, the voltage at the first node N1 changes from Vdata to Vref, i.e., by Vdata−Vref. Therefore, the gate voltage Vg6 of the sixth thin-film transistor M6 is given as:

$$Vg6=VDD-Vth-(Vdata-Vref) \quad \text{Eqn. 1,}$$

where, Vth is the absolute value of the threshold voltage of the sixth thin-film transistor M6, VDD is the first power supply voltage provided by the first power source ELVDD, Vdata is the data voltage provided by the data line DATA, and Vref is the initialization voltage provided by the reference power source VREF.

As the source voltage of the sixth thin-film transistor M6 is equal to the first power supply voltage VDD provided by the first power source ELVDD, the gate-source voltage Vsg6 of the sixth thin-film transistor M6, i.e., a voltage difference between the gate and source of the sixth thin-film transistor M6, is:

$$Vsg6=VDD-(VDD-Vth-(Vdata-Vref)) \quad \text{Eqn. 2,}$$

From Eqns. 1 and 2, we can obtain:

$$Vsg6-Vth=Vdata-Vref \quad \text{Eqn. 3.}$$

The organic light-emitting diode OLED emits light in proportion to the current Ion flowing therein, which is give by:

$$Ion=K\times(Vsg6-Vth)^2 \quad \text{Eqn. 4,}$$

where, K is the product of the electron mobility, aspect ratio and capacitance per unit area of the thin-film transistor.

From Eqns. 3 and 4, the following equation can be obtained:

$$Ion=K\times(Vdata-Vref)^2.$$

As indicated by this equation, the current flowing in the organic light-emitting diode OLED is independent of the power supply voltages and the threshold voltage of the sixth thin-film transistor M6, and is related only to the data voltage Vdata, the initialization voltage Vref and the constant K. Therefore, even if there were variations in the threshold voltages of the sixth thin-film transistors M6 and an impact of power wiring impedances on the power supply voltages actually acting on the pixel circuits, the currents Ion in the organic light-emitting diodes OLED would not be affected at all. Thus, the problem of non-uniform brightness arising from threshold voltage variations and power wiring impedances can be overcome by use of the pixel circuit 20 and the method for driving it. At the same time, the service lives of the organic light-emitting diodes OLED and the sixth thin-film transistors M6 that serve as drive transistors can also be extended.

Embodiment 2

Figure 4:
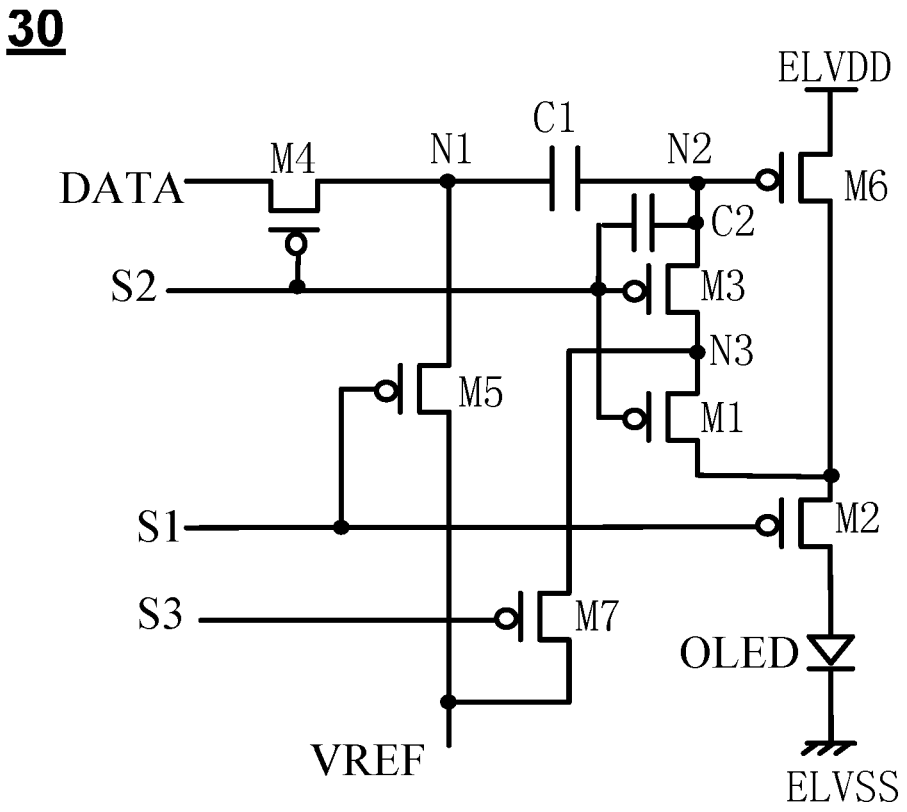
FIG. 4 is a diagram of a pixel circuit in accordance with a second embodiment of the present invention.

Reference is now made to FIG. 4, which is a diagram of a pixel circuit in accordance with a second embodiment of the present invention. As shown in FIG. 4, the pixel circuit 30 comprises a first thin-film transistor M1, a second thin-film transistor M2, a third thin-film transistor M3, a fourth thin-film transistor M4, a fifth thin-film transistor M5, a sixth thin-film transistor M6, a seventh thin-film transistor M7, a capacitor C1 and an organic light-emitting diode OLED. A source of the sixth thin-film transistor M6 is connected to a first power source ELVDD, and a drain of the sixth thin-film transistor M6 is connected to both a drain of the first thin-film transistor M1 and a source of the second thin-film transistor M2. A drain of the second thin-film transistor M2 is connected to an anode of the organic light-emitting diode OLED, and a cathode of the organic light-emitting diode OLED is connected to a second power source ELVSS. A gate of the sixth thin-film transistor M6 is connected to a source of the third thin-film transistor M3 and a first terminal of the capacitor C1. A second terminal of the capacitor C1 is connected to both a drain of the fourth thin-film transistor M4 and a source of the fifth thin-film transistor M5. A source of the fourth thin-film transistor M4 is connected to a data line DATA, and a drain of the fifth thin-film transistor M5, together with a drain of the seventh thin-film transistor M7, is connected to a reference power source VREF. A source of the seventh thin-film transistor M7 is connected to both a source of the first thin-film transistor M1 and a drain of the third thin-film transistor M3.

Specifically, the pixel circuit 30 possesses all the features of the pixel circuit 20 of Embodiment 1, and this embodiment differs from Embodiment 1 in that a boost capacitor C2 is further disposed between a second node N2 and a second scan line S2, which is configured to raise the voltage at the second node N2.

Figure 3:
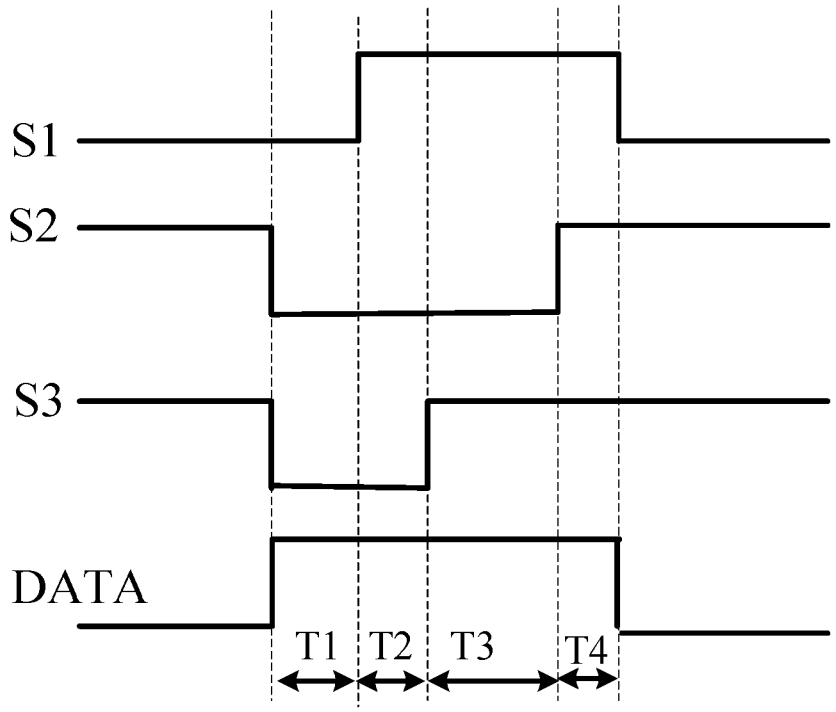
FIG. 3 is a timing diagram illustrating a method of driving the pixel circuit in accordance with the first embodiment of the present invention.

With combined reference to FIGS. 3 and 4, in the fourth phase T4, when a scan signal provided by the second scan line S2 jumps from the low level to the high level, the boost capacitor C2 pulls up the voltage at the second node N2, so as to raise the voltage at the second node N2, i.e., the gate voltage Vg6 of the sixth thin-film transistor M6, according to the amount of change in the scan signal provided by the second scan line S2 and a ratio of a capacitance of the boost capacitor C2 to the sum of a capacitance of the capacitor C1 and the capacitance of the boost capacitor C2, i.e., {C2/(C1+C2)}, such that current leakage in the sixth thin-film transistor M6 is reduced and an improvement in display contrast can be obtained.

In this embodiment, the scan signals provided by the first scan line S1, the second scan line S2 and the third scan line S3 evolve in the same time sequence as those provided by the first scan line S1, the second scan line S2 and the third scan line S3 of Embodiment 1, which will not be described in duplicate again. Regarding to the details, reference can be made to the description of Embodiment 1 with respect to the first to fourth phases T1-T4 in the method for driving the pixel circuit.

It is noted that the embodiments disclosed herein are described in a progressive manner in which each embodiment is described with the emphasis on its differences from other embodiments, and reference can be made between different embodiments for the same features. In addition, in the disclosed embodiments, as the pixel circuits correspond to the methods for driving them, they are described in a simpler way, and reference can be made to the description of the methods for the corresponding features of the pixel circuits.

Accordingly, the present invention also provides organic light-emitting display devices comprising the pixel circuits as defined above.

Conclusively, in the pixel circuits and the methods for driving them, as well as the organic light-emitting display devices, according to the present invention, through anode initialization of the organic light-emitting diode via the first thin-film transistor, the second thin-film transistor and the seventh thin-film transistor, as well as gate and drain initialization of the sixth thin-film transistor that serves as a driving element via the first thin-film transistor, the third thin-film transistor and the seventh thin-film transistor, aging of the organic light-emitting diode and the sixth thin-film transistor can be slowed, and their service lives can be extended. In addition, because the current output by the sixth thin-film transistor is independent of its threshold voltage and power wiring impedances, the problem of brightness non-uniformity caused by variations in thin-film transistor threshold voltages and power wiring impedances can be addressed. Further, an improvement in display contrast can be obtained by increasing the gate voltage of the sixth thin-film transistor by the boost capacitor and thereby reducing current leakage therein. Thus, use of the pixel circuits and the methods for driving them for the organic light-emitting display devices can result in not only service life extension but also an improvement in display quality.

The foregoing description is merely preferred embodiments of the present invention and does not limit the scope of the invention in any way. All changes and modifications made by those of ordinary skill in the art concerning the foregoing disclosure fall within the scope of the appended claims.

What is claimed is:

1. A method for driving a pixel circuit, the circuit comprising a first thin-film transistor, a second thin-film transistor, a third thin-film transistor, a fourth thin-film transistor, a fifth thin-film transistor, a sixth thin-film transistor, a seventh thin-film transistor, a capacitor and an organic light-emitting diode, wherein a source of the sixth thin-film transistor is connected to a first power source;

a drain of the sixth thin-film transistor is connected to both a drain of the first thin-film transistor and a source of the second thin-film transistor; a drain of the second thin-film transistor is connected to an anode of the organic light-emitting diode; a cathode of the organic light-emitting diode is connected to a second power source;

a gate of the sixth thin-film transistor is connected to a source of the third thin-film transistor and a first terminal of the capacitor; a second terminal of the capacitor is connected to both a drain of the fourth thin-film transistor and a source of the fifth thin-film transistor; a source of the fourth thin-film transistor is connected to a data line;

a drain of the fifth thin-film transistor, together with a drain of the seventh thin-film transistor, is connected to a reference power source;

and a source of the seventh thin-film transistor is connected to both a source of the first thin-film transistor and a drain of the third thin-film transistor, wherein the method comprising:

a scan period including a first phase, a second phase, a third phase and a fourth phase, wherein in the first phase, a scan signal provided by the first scan line that is connected to the gates of the second thin-film transistor and the fifth thin-film transistor is maintained at a low level and a scan signal provided by the second scan line that is connected to the gates of the first thin-film transistor, the third thin-film transistor and the fourth thin-film transistor and a scan signal provided by the third scan line that is connected to the gate of the seventh thin-film transistor are both pulled down from a high level to the low level, leading to the first thin-film transistor, the third thin-film transistor, the fourth thin-film transistor and the seventh thin-film transistor being turned on, the gate and drain of the sixth thin-film transistor and the anode of the organic light-emitting diode being initialized by an initialization voltage provided by the reference power source, and a data voltage provided by the data line being written, via the fourth thin-film transistor, to a connection point among the drain of the fourth thin-film transistor, the source of the fifth thin-film transistor and the second terminal of the capacitor;

in the second phase, the scan signal provided by the first scan line jumps from the low level to the high level and the scan signals provided by the second scan line and the third scan line are maintained at the low level, leading to the second thin-film transistor and the fifth thin-film transistor being turned off and the initialization of the anode of the organic light-emitting diode being terminated;

in the third phase, the scan signal provided by the first scan line is maintained at the high level, the scan signal provided by the second scan line is maintained at the low level and the scan signal provided by the third scan line jumps from the low level to the high level, leading to the seventh thin-film transistor being turned off, the second thin-film transistor and the fifth thin-film transistor being kept off, the initialization of the gate and drain of the sixth thin-film transistor being terminated, and a threshold voltage of the sixth thin-film transistor being sampled;

in the fourth phase, the scan signals provided by the first scan line and the third scan line are maintained at the high level and the scan signal provided by the second scan line jumps from the low level to the high level, leading to the first thin-film transistor, the third thin-film transistor and the fourth thin-film transistor being turned off, writing of the data voltage being terminated, and the sampling of the threshold voltage of the sixth thin-film transistor being completed, and following the completion of the sampling in the fourth phase, the scan signal provided by the first scan line drops from the high level to the low level, leading to the second thin-film transistor and the fifth thin-film transistor being turned on, and the sixth thin-film transistor outputting a current via the second thin-film transistor, which drives the organic light-emitting diode to emit light.

2. The method of claim 1, wherein the first power source and the second power source are configured to provide the organic light-emitting diode with power supply voltages; and the reference power source is configured to provide an initialization voltage to the gate and drain of the sixth thin-film transistor and the anode of the organic light-emitting diode.

3. The method of claim 1, wherein the gates of the second thin-film transistor and the fifth thin-film transistor are both connected to a first scan line which is configured for initialization control and capacitor stabilization; the gates of the first thin-film transistor, the third thin-film transistor and the fourth thin-film transistor are all connected to a second scan line which is configured to control writing of a data voltage and sample a threshold voltage of the sixth thin-film transistor; and the gate of the seventh thin-film transistor is connected to a third scan line which is configured to control writing of an initialization voltage.

4. The method of claim 3, the circuit further comprising a boost capacitor disposed between the second scan line and a connection point among the gate of the sixth thin-film transistor, the source of the third thin-film transistor and the first terminal of the capacitor.

5. The method of claim 1, wherein a scan period for driving the pixel circuit comprises a first phase, a second phase, a third phase and a fourth phase;

wherein an initialization of the gate and drain of the sixth thin-film transistor and the anode of the organic light-emitting diode is started at a beginning of the first phase; the initialization of the anode of the organic light-emitting diode is terminated at an end of the second phase; the initialization of the gate and drain of the sixth thin-film transistor is terminated at an end of the third phase; a threshold voltage of the sixth thin-film transistor is sampled in the third phase; and the sixth thin-film transistor is turned on and provides a current to the organic light-emitting diode in the fourth phase.

6. The method of claim 1, wherein a current provided by the sixth thin-film transistor to the organic light-emitting diode is determined by a data voltage provided by the data line and an initialization voltage provided by the reference power source, and is independent of the power supply voltages provided by the first power source and the second power source and a threshold voltage of the sixth thin-film transistor.

7. The method of claim 1, wherein when the seventh thin-film transistor and the third thin-film transistor are simultaneously turned on, the gate of the sixth thin-film transistor is initialized by the reference power source;

when the first thin-film transistor and the seventh thin-film transistor are simultaneously turned on, the drain of the sixth thin-film transistor is initialized by the reference power source;

when the first thin-film transistor, the second thin-film transistor and the seventh thin-film transistor are simultaneously turned on, the anode of the organic light-emitting diode is initialized by the reference power source.

8. The method of claim 1, wherein in the fourth phase, in response to the scan signal provided by the second scan line, a boost capacitor disposed between the second scan line and the gate of the sixth thin-film transistor raises a voltage at a connection point among the gate of the sixth thin-film transistor, the source of the third thin-film transistor and the first terminal of the capacitor, such that a gate voltage of the sixth thin-film transistor is increased.

9. The method of claim 1, wherein the first power source and the second power source are configured to provide the organic light-emitting diode with power supply voltages; and the reference power source is configured to provide an initialization voltage to the gate and drain of the sixth thin-film transistor and the anode of the organic light-emitting diode.

10. The method of claim 1, wherein the gates of the second thin-film transistor and the fifth thin-film transistor are both connected to a first scan line which is configured for initialization control and capacitor stabilization; the gates of the first thin-film transistor, the third thin-film transistor and the fourth thin-film transistor are all connected to a second scan line which is configured to control writing of a data voltage and sample a threshold voltage of the sixth thin-film transistor; and the gate of the seventh thin-film transistor is connected to a third scan line which is configured to control writing of an initialization voltage.

11. The method of claim 10, the circuit further comprising a boost capacitor disposed between the second scan line and a connection point among the gate of the sixth thin-film transistor, the source of the third thin-film transistor and the first terminal of the capacitor.

12. The method of claim 1, wherein a scan period for driving the pixel circuit comprises a first phase, a second phase, a third phase and a fourth phase;

wherein an initialization of the gate and drain of the sixth thin-film transistor and the anode of the organic light-emitting diode is started at a beginning of the first phase; the initialization of the anode of the organic light-emitting diode is terminated at an end of the second phase; the initialization of the gate and drain of the sixth thin-film transistor is terminated at an end of the third phase; a threshold voltage of the sixth thin-film transistor is sampled in the third phase; and the sixth thin-film transistor is turned on and provides a current to the organic light-emitting diode in the fourth phase.

13. The method of claim 1, wherein a current provided by the sixth thin-film transistor to the organic light-emitting diode is determined by a data voltage provided by the data line and an initialization voltage provided by the reference power source, and is independent of the power supply voltages provided by the first power source and the second power source and a threshold voltage of the sixth thin-film transistor.

14. The method of claim 1 for an organic light-emitting display device.

15. The method of claim 14, wherein the first power source and the second power source are configured to provide the organic light-emitting diode with power supply voltages; and the reference power source is configured to provide an initialization voltage to the gate and drain of the sixth thin-film transistor and the anode of the organic light-emitting diode.

16. The method of claim 14, wherein the gates of the second thin-film transistor and the fifth thin-film transistor are both connected to a first scan line which is configured for initialization control and capacitor stabilization; the gates of the first thin-film transistor, the third thin-film transistor and the fourth thin-film transistor are all connected to a second scan line which is configured to control writing of a data voltage and sample a threshold voltage of the sixth thin-film transistor; and the gate of the seventh thin-film transistor is connected to a third scan line which is configured to control writing of an initialization voltage.

17. The method of claim 16, further comprising a boost capacitor disposed between the second scan line and a connection point among the gate of the sixth thin-film transistor, the source of the third thin-film transistor and the first terminal of the capacitor.

18. The method of claim 14, wherein a scan period for driving the pixel circuit comprises a first phase, a second phase, a third phase and a fourth phase;

wherein an initialization of the gate and drain of the sixth thin-film transistor and the anode of the organic light-emitting diode is started at a beginning of the first phase; the initialization of the anode of the organic light-emitting diode is terminated at an end of the second phase; the initialization of the gate and drain of the sixth thin-film transistor is terminated at an end of the third phase; a threshold voltage of the sixth thin-film transistor is sampled in the third phase; and the sixth thin-film transistor is turned on and provides a current to the organic light-emitting diode in the fourth phase.

19. The method of claim 14, wherein a current provided by the sixth thin-film transistor to the organic light-emitting diode is determined by a data voltage provided by the data line and an initialization voltage provided by the reference power source, and is independent of the power supply voltages provided by the first power source and the second power source and a threshold voltage of the sixth thin-film transistor.

* * * * *